United States Patent [19]

Ashok et al.

[11] Patent Number: 4,953,382

[45] Date of Patent: Sep. 4, 1990

[54] EXTRUSION OF STRIP MATERIAL

[75] Inventors: Sankaranarayanan Ashok, Bethany; Harvey P. Cheskis, North Haven; Eugene Shapiro, Hamden, all of Conn.

[73] Assignee: Olin Corporation, New Haven, Conn.

[21] Appl. No.: 447,762

[22] Filed: Dec. 8, 1989

[51] Int. Cl.[5] ..... B21C 23/01; B21C 25/02

[52] U.S. Cl. ..... 72/262

[58] Field of Search ..... 72/262

[56] References Cited

U.S. PATENT DOCUMENTS

| | | | |
|---|---|---|---|
| 3,765,216 | 10/1973 | Green | 72/262 |
| 3,872,703 | 3/1975 | Green | 72/262 |
| 4,041,745 | 8/1977 | Moreau | 72/262 |
| 4,362,485 | 12/1982 | Slater et al. | 72/262 |
| 4,378,686 | 4/1983 | Pardoe | 72/262 |
| 4,397,622 | 8/1983 | Childs et al. | 72/262 |
| 4,419,324 | 12/1983 | Childs et al. | 419/67 |
| 4,468,945 | 9/1984 | Fairey | 72/262 |
| 4,505,878 | 3/1985 | Childs et al. | 72/262 |
| 4,557,894 | 12/1985 | Bangay et al. | 72/39 |
| 4,564,347 | 1/1986 | Vaughan | 72/268 |
| 4,566,303 | 1/1986 | McKenna | 72/262 |
| 4,601,325 | 7/1986 | Maddock | 164/476 |

FOREIGN PATENT DOCUMENTS

| | | | |
|---|---|---|---|
| 156833 | 9/1982 | Japan | 72/262 |
| 18204 | 1/1985 | Japan | 72/262 |

OTHER PUBLICATIONS

Continuous Extrusion Complete Conform-Castex Technology for Aluminum and Copper—Holten Machinery Ltd. Pamphlet.

Continuous Extrusion Conform by Holten, Castex--Aluminum Molten Metal Feed—Holten Machinery Ltd. Pamphlet.

Recent Developments in Conform and Castex Continuous Extrusion Technology by Langowerger & Maddock, Aug. 1988, pp. 23-28 (Light Metal Age).

*Primary Examiner*—Lowell A. Larson

*Attorney, Agent, or Firm*—H. Samuel Kieser

[57] ABSTRACT

A metal extrusion process and apparatus therefor in which a strip material of a rectangular shape may be produced by maintaining frictional engagement of the metal by passageway-defining surfaces of a member which is moved toward a die such that the frictional drag of the passageway-defining surfaces urges the metal through the die. The process utilizes strip material as the starting material which enables the extrusion of metal strip by the frictional drag process to be accomplished.

8 Claims, 1 Drawing Sheet

EXTRUSION OF STRIP MATERIAL

This invention relates to the forming of metal shapes by extrusion and more particularly to the extrusion of strip material by starting with a striP material. The extruded strip may have an irregular cross-sectional configuration, if desired.

A process and apparatus for continuous friction-actuated extrusion is described in U.S. Pat. No. 3,765,216. This process is now known in the metal fabricating industry as the Conform Process. This process comprises the steps of feeding metal into one end of a passageway formed between first and second members, with the second member having a greater surface area for engaging the material than the first member. The passageway is blocked at one end, remote from the feeding end, and has at least one die orifice associated with the blocked end. The moving of the passageway-defining surface of the second member relative to the Passage-defining surface of the first member in a direction towards the die orifice from the first end to the blocked end is such that the frictional drag of the passageway-defining surface of the second member draws the material through the passageway and generates in it a pressure that is sufficient to extrude it through the die orifice.

In the usual practical application of the Conform Process, the passageway is arcuate with the second member comprising a wheel with a groove formed in the surface into which the first member projects. The blocked end of the passageway is defined by an abutment projecting from the first member into the groove.

The Conform Extrusion Process is more fully explained in the pamphlets of Holten Machinery Ltd. entitled "Continuous Extrusion Conformed by Holten Single Wheel Extruders" and "Manufacturer of Shapes for Electrical Cables and Other Products by the Conform Extrusion Process".

Other patents relating to this type of extrusion process include the U.S. Pat. Nos. 3,872 703, 4,362,485, 4,378,686, 4,397,622, 4,419,324, 468,945, 4,505,878, 4,564,347, 4,557,894, and 4,566,303.

The Conform Process is specifically adapted for the feeding of a solid rod or metal powder into the passageways of the apparatus for extrusion into rod-like shapes. A modification to such process has been made in which molten metal is used as the starting material. This type of process, known as the Castex Process, is more fully described in U.S. Pat. No. 4,601,325. According to that patent, a wheel is provided having an endless peripheral groove therein which is rotated about a horizontal axis and a fixed structure which cooperates with the wheel to cover the groove along a part of its length to form a passageway in which is provided with a die orifice leading from the closed off passageway. According to that process, molten metal is fed into the passageway and cooling is provided so that the molten metal is solidified before it is forced through the die orifice.

The Conform and Castex processes are further described in Holten Machinery Ltd. pamphlets entitled "Continuous Extrusion Complete Conform-Castex Technology for Aluminum and Copper", and "Continuous Extrusion Conform . . . by Holten, Castex-Aluminum Molten Metal Feed". Additionally, an article entitled "Recent Developments in Conform and Castex Continuous Extrusion Technology" by Langowerger and Maddock appearing in *Light Metal Age,*

August, 1988, pages 23–28, also provides a description of the two processes.

Both the Conform and Castex processes have, in general, been limited to the production of rod-like shapes from either rod or granules of various sizes or, as in the case of the Castex Process, from a starting material in molten form.

In the case of copper, copper alloys, and other higher melting materials, the width of the product which can be produced is somewhat limited by the present Conform Process utilizing rods, granules, or powder. In an attempt to make relatively wider products, the present Conform machine requires an expansion chamber to allow the narrow incoming stock to be expanded before being extruded through the die. The geometry of the expansion chamber requires that the side walls flare out gradually rather than abruptly. This geometric requirement places the exit die relatively far away from the point of entry of the consolidated material and results in extrusion forces which are beyond practical limits. Additionally, at the extrusion temperatures required, the loads develoPed on the abutment member or blocking member are higher than the yield strength of the conventional tools used for copper alloys and other higher melting materials.

Accordingly, it is an object of the present invention to provide a modification of the "friction-actuated" extrusion process and apparatus to provide strip-type material.

It is a further object of the present invention to provide an extrusion process and apparatus in which a strip material is extruded from a starting material which is also in strip form.

It is a further object of the present invention to provide an improved extrusion process and apparatus which permits the extrusion of strip material having an irregular cross section.

These and other objects and advantages of the present invention may be accomplished through the provision of a process and apparatus for forming metal shapes which have a larger width than height in cross section. The process may comprise feeding metal in elongated strip form continuously into an end of a passageway formed between a first member and second member.

The first member has a greater surface area for engaging the metal than the second member. The passageway has a closed end remote from the end into which the material is fed and includes a die means adjacent to the closed end. The die means has an opening of a predetermined configuration which has a greater overall width than height. The first member is moved relative to the second member in the direction toward the die means from the feed end so that the frictional drag of the passageway defining surface of the first member draws the metal through the passageway and through the die means.

The present invention may be more readily understood by reference to the following detailed description and to the accompanying drawings in which.

Figure 1:
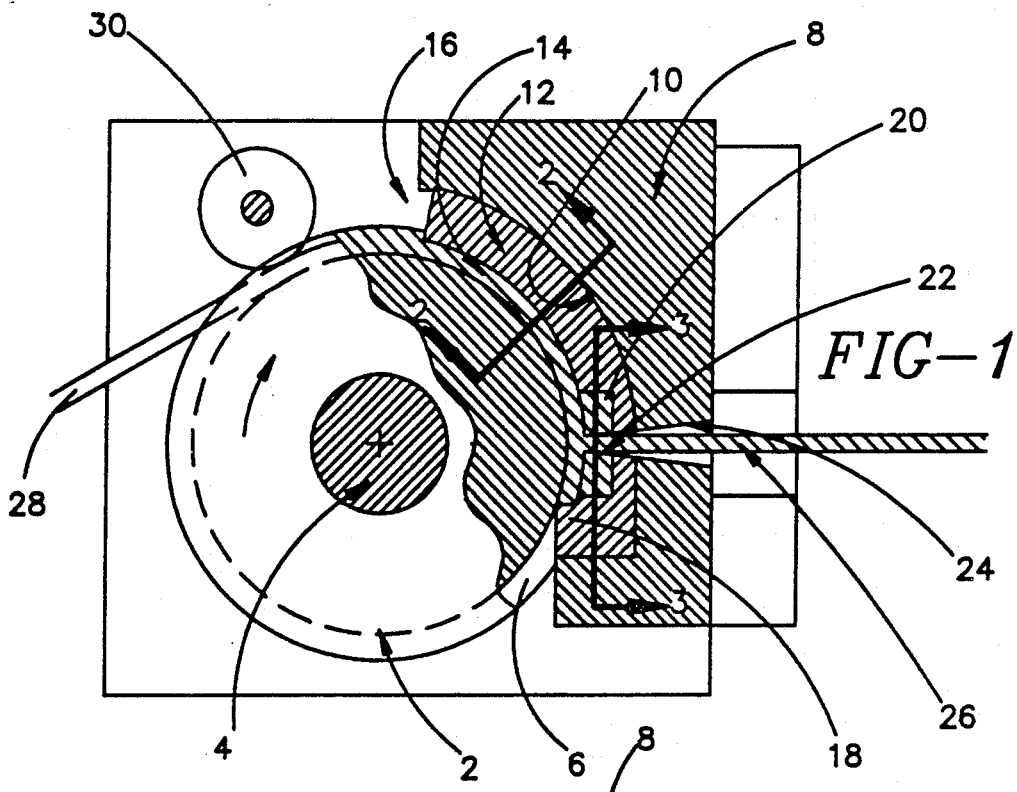
FIG. 1 is a elevational view, partially in section of an extrusion apparatus incorporating the present invention.

Referring now to the drawings, the extrusion apparatus shown therein comprises a first member in the form of a wheel 2 rotatively mounted on a shaft 4. The wheel is formed with a continuous peripheral groove 6 having a rectangular cross section. A second member, in the form of a shoe 8 extends about a portion of the periphery of the wheel 2 and includes a groove 10 in which is mounted a removable abutment or insert member 12.

The insert member 12 projects into the groove 6 in the wheel 2, forming a rectangular passageway 14 and includes an open-end portion 16 and enclosed end portion forming an abutment portion 18 which substantially blocks the groove and hence the passageway 14 formed between the wheel 2 and the shoe 8. Alternatively, the abutment portion 18 may be formed as a member separate from the insert 12. Suitable means, not shown, may be provided for releasably securing the insert or abutment member 12 within the shoe 8, and also for readily adjusting the position of the insert member 12 within the groove 6 in the wheel 2 to define the thickness of the passageway 14 formed between the wheel 2 and insert 12.

A die member 20 is provided adjacent the closed end portion 18 of the passageway 14 and is in communication therewith. Preferably, the die member 20 is mounted in the insert member 12 and has an opening 22 therethrough which communicates directly with the passageway 14. The die member 20 may be formed in one or two pieces depending upon the configuration of its opening. A suitable opening 24, which may be outwardly tapered as shown, is provided in the insert member 12 and shoe 8 on the opposite side of the die member 20 from the passageway 14 to permit the exit of the extruded material from the apparatus.

Figure 3:
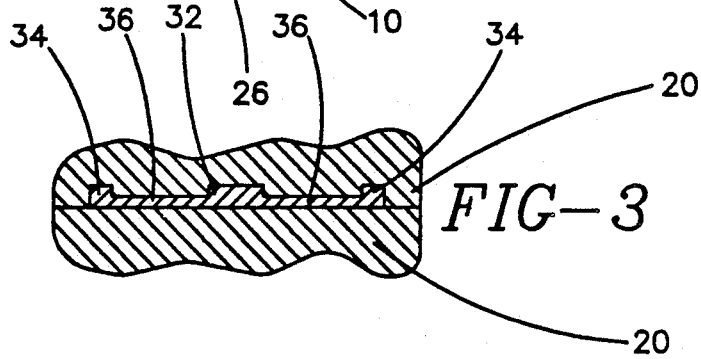
FIG. 3 is a partial sectional view taken along the lines 3—3 of FIG. 1.

The apparatus described is particularly adapted for use in forming an irregularly shaped, continuous relatively thin strip of material 26 which includes portions of reduced cross section as shown in FIG. 3. The starting material is preferably a substantially continuous strip material 28 of the desired metal or alloy having a rectangular cross section and having a substantially greater width than height. The strip material 28 is fed into the open end of the passageway 14 formed by the groove 6 in the wheel 2 and the surface of the insert 12 extending thereinto. A coining roll 30 may be provided to assist in feeding the strip material into the opening 14 in the passageway formed between the wheel 2 and the shoe 8.

As mentioned above, the particular process and apparatus described herein is particularly adapted for extruding strip material into strip material of irregular cross-sectional shape. For example, the strip material fed into the opening 16 of the passageway 14 has a generally rectangular cross section with a relatively large width with respect to its height. By way of example, the width of the material may be over 2 inches, while the height or thickness of the strip material may be 0.50 inch or less. Ideally, the strip material has a height to width ratio of 0.5 or less. The configuration of the die member 20 may be such that the extruded strip material produced has a generally irregular cross section. The overall height-to-width ratio of the extruded strip is 0.5 or less. For example, as shown in FIG. 3, the extruded product has generally the same overall width as the strip, as well as the overall height. However, the cross section is irregular and may comprise a central raised portion 32 and two raised end portions 34 with the material 36 immediate to central and end portions being of reduced cross section. Such a shape when fabricated from a copper or copper alloy material has use in electronic applications and a product of this shape may be subjected to rolling and the strip cut to the approximate shape after extruding to produce terminal members, contact members, reeds, and lead frames.

Figure 2:
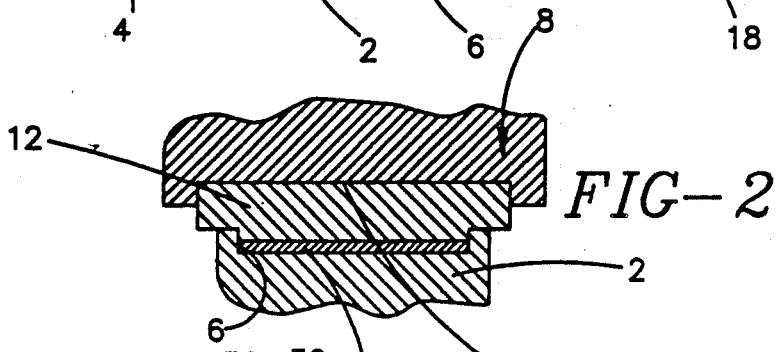
FIG. 2 is a sectional view taken along the lines 2—2 of FIG. 1.

In use, the strip material is fed into the groove 6 in the wheel 2 underneath the coining roll 30 into the open end 16 of the passageway 14 formed between the shoe 8 and the wheel 2. The amount of surface area of the passageway 14 defined by the groove 6 in the wheel 2 is greater than the surface area of the passageway defined by the surface of the abutment or insert 12 the wheel. Thus, as the wheel 2 is rotated in a clockwise direction, as indicated in FIG. 2, thus moving from the open end 16 to the closed end 18 of the passageway, it frictionally drags the material fed into the passageway towards the abutment 18 and through the die member 20 resulting in a continuous strip of appropriate cross section issuing from the die member 20.

As described above, by virtue of feeding strip material into a friction-actuated extrusion apparatus, it is possible to extrude strip material from metal alloys having relatively high yield strengths. The use of the strip starting material Provides a greater surface area for engagement during the extrusion process and also substantially eliminates the necessity for an expansion chamber in the apparatus. The process and apparatus of the present invention permits the making of such strip material from a starting material having an overall dimension substantially equal to the overall dimension of the end products, with the final strip product having an irregular cross section, if desired.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A process for forming metal shapes having a substantially larger width than height in cross section, said process comprising:

a. feeding material in elongated strip form into one end of a passageway formed between a first member and a second member, said strip having a substantially larger width than height in cross section, said first member having a greater surface area for engaging said metal than said second member, said passageway having a closed end remote from said one end and having die means adjacent said closed end, said die means having an opening of predetermined configuration which has a greater overall width than height, and b. moving said first member relative to said second member in a direction toward said die means from said one end to said closed end so that the frictional drag of the passageway defining surface of the first member draws the metal through the passageway and through the die means.

2. The process of claim 1 wherein said extruded material has an overall height-to-width ratio of 0.5 or less.

3. The process of claim 2 wherein said strip material being fed into said passageway has a height-to-width ratio of 0.50 or less.

4. The process, according to claim 1, wherein said passageway is formed between a rotatable wheel member having an endless groove therein and a shoe member covering a part of the length of the groove, and wherein the wheel is rotated in a direction to drag metal through the passageway and the die means.

5. The process, according to claim 1, wherein said die means has an opening having an irregular cross section.

6. An extrusion apparatus for extruding strip material comprising first and second members defining an elongated passageway therebetween, said passageway having a greater width than height, said first and second members being movable one relative to the other in the direction of the length of the passageway, means blocking said passageway at one end thereof, an orifice extending from said passageway adjacent said abutment, die means communicating with said orifice, said die means including an opening therethrough having an overall width which is substantially greater than the overall height, means for continuously feeding strip material into said passageway at a point spaced from the abutment means, the amount of surface area of the passageway defined by the first member which is movable towards the abutment member being greater than the amount of surface area of the passageway defined by the second member whereby material fed into the passageway is moved by frictional drag with the surfaces of the passageway in the first member towards the abutment member and is thereby extruded through the die opening.

7. The extrusion apparatus of claim 6 wherein said first member comprises a wheel member having an endless groove therein, said second member comprises a shoe member covering only a part of the length of the groove in the wheel and forming a passageway therewith, and said abutment member projects from the shoe member into the groove and blocks one end of the passageway.

8. The extrusion apparatus of claim 6 wherein said die opening has an irregular cross section.

* * * * *